United States Patent [19]

Melin et al.

[11] 4,334,385

[45] Jun. 15, 1982

[54] FLYING DISC

[75] Inventors: Arthur K. Melin; Richard L. Gillespie, both of San Gabriel; Douglas A. Geller, Monrovia, all of Calif.

[73] Assignee: Wham-O Mfg. Co., San Gabriel, Calif.

[21] Appl. No.: 91,580

[22] Filed: Nov. 5, 1979

[51] Int. Cl.[3] ..... A63H 27/00

[52] U.S. Cl. ..... 46/74 D; 273/424

[58] Field of Search ..... 46/74 D, 75; 273/424, 273/425

[56] References Cited

U.S. PATENT DOCUMENTS

| | | | |
|---|---|---|---|
| 3,724,122 | 4/1973 | Gillespie, Sr. | 273/424 X |
| 3,900,987 | 8/1975 | Holt | 46/74 D |
| 4,112,612 | 9/1978 | Woods | 46/74 D |
| 4,132,030 | 1/1979 | Lehman | 46/74 D |
| 4,176,843 | 12/1979 | DeWitt, Jr. | 273/424 X |
| 4,212,131 | 7/1980 | Ross, Jr. | 46/74 D |

*Primary Examiner*—Gene Mancene
*Assistant Examiner*—Mickey Yu
*Attorney, Agent, or Firm*—Christie, Parker & Hale

[57] ABSTRACT

An aerodynamically-shaped flying disc comprised of two separate and distinct parts, a disc body portion and one or more separate rim portions. In one embodiment, the connection between the body and rim portions is permanent. In a second embodiment, the connection is disengageable to permit the use of interchangeable rim portions of different aerodynamic configurations, colors, dimensions and weights.

12 Claims, 23 Drawing Figures

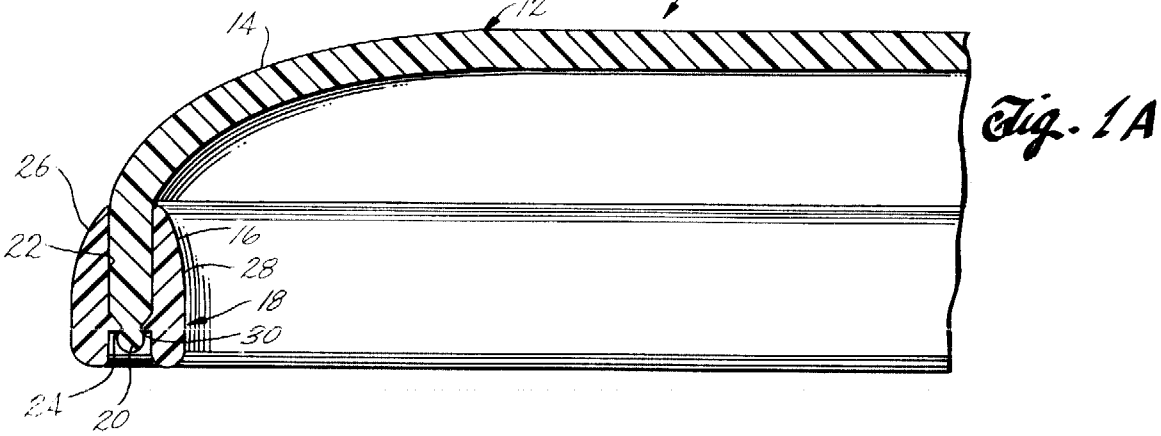
Fig. 1A
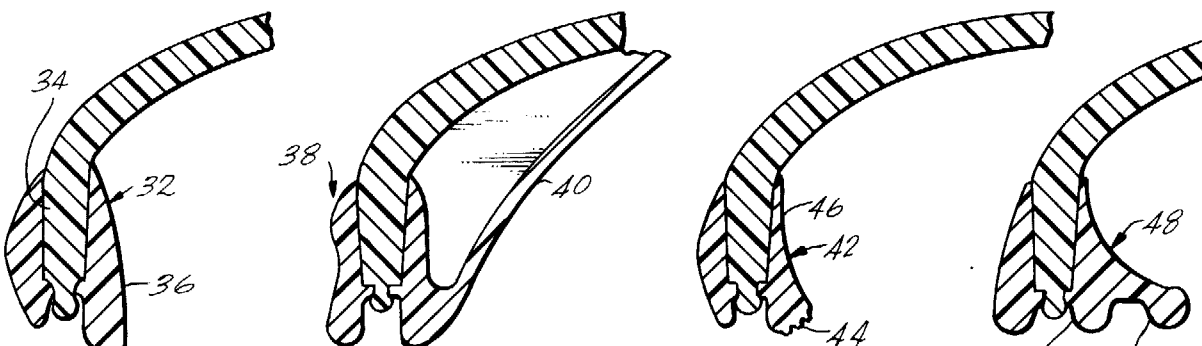
Fig. 1B
Fig. 1C
Fig. 1D
Fig. 1E

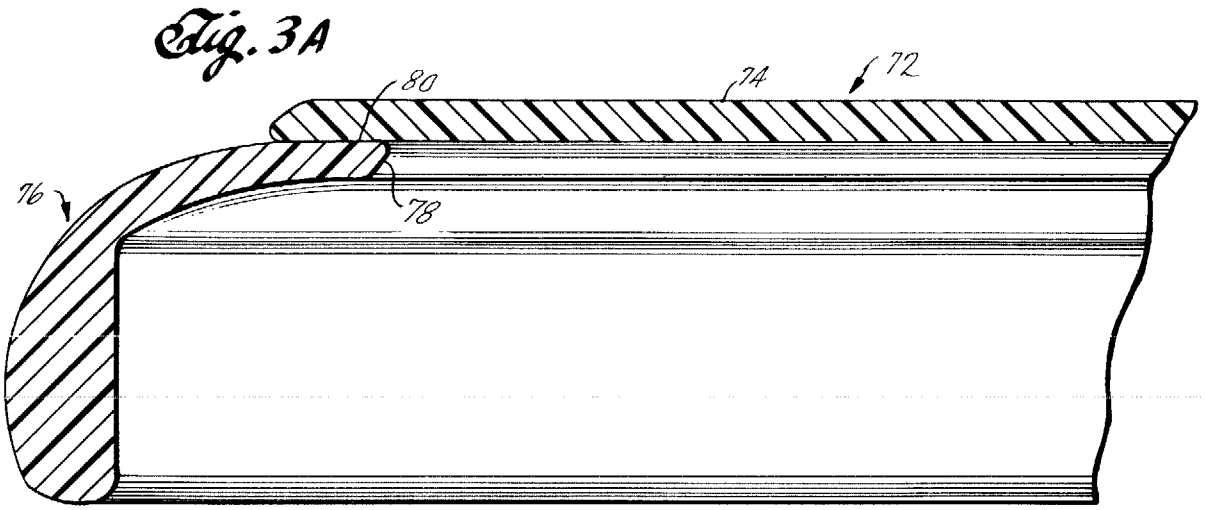
Fig. 3A
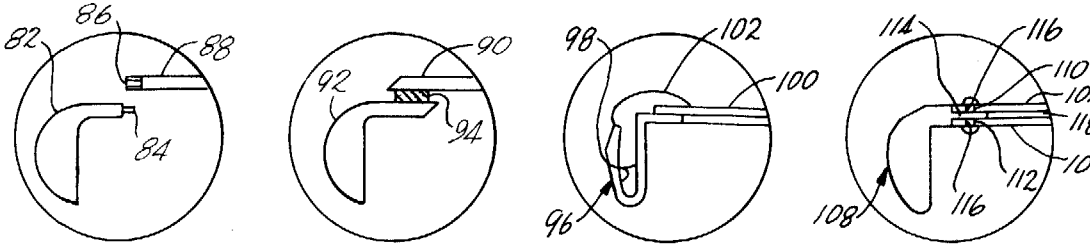
Fig. 3B
Fig. 3C
Fig. 3D
Fig. 3E
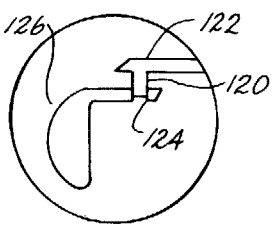
Fig. 3F
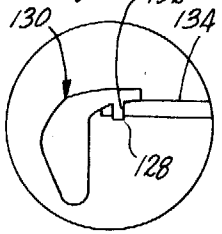
Fig. 3G

FLYING DISC

DESCRIPTION OF THE PRIOR ART

The present invention relates to flying discs and, in particular, two-piece flying discs having interchangeable rim portions to provide different weighting and flight characteristics.

The phenomenal popularity of the sport of flying discs over the past twenty years has been recounted and documented numerous times in the daily media and in innumerable books and magazine articles. Starting with the disc of U.S. Pat. No. De. 183,626 and progressing to the disc described and illustrated in U.S. Pat. No. 3,359,462, disc flying utilizing the well-known FRISBEE flying disc has become a leisure time, recreational and sports activity of all generations, but one which enjoys its greatest popularity with those in the teen years and into the early twenties.

As the popularity of such discs have grown, so have the skills displayed in using them. An important aspect of their appeal in the challenge presented in mastering the finer techniques of both throwing and catching. As skills increase, so does critical evaluation of the various factors which contribute to the flight characteristics of such discs. Subtle changes in weight and shape have been found to produce significant effects on disc performance, leading to the introduction of discs of different diameters, cross-sectional profiles and weights. The result has been a series of discs of specific size and weight relationships that are specifically suited to produce flights of long distance, flights calling for great control and accuracy and flights of maximum duration. Similarly, discs of certain sizes and weights are specifically suited for team sports, for flights of maximum duration. Similarly, discs of certain sizes and weights are specifically suited for team sports, for flights resulting in a curved trajectory to permit the disc to be thrown around or behind obstacles, and for free style activities.

Other variables in disc flying which make a variety of disc sizes and weights desirable are the skill, technique and personal preferences of each particular user. Some users prefer throwing a disc with a backhand launch, others use a forehand. Different grips lead to a variety of preference in disc profiles. To skilled practitioners of disc flying, the identically same disc has different flight characteristic in the hands of two different users.

SUMMARY OF THE PRESENT INVENTION

The present invention provides an aerodynamically-shaped circular flying disc comprising a circular central portion of a generally uniform cross-section and a separate rim portion of a generally larger cross-section secured to the central portion. The cross-sectional profile of the central portion and the rim portion conform to that of air foil.

Alternatively, the invention provides an aerodynamically-shaped flying disc which comprises an inverted saucer-shaped body portion having a central, generally flat, circular portion bounded by a downwardly-depending outer portion providing the body portion with an upwardly-directed convex configuration and a downwardly-directed concave configuration. The body portion is provided with a generally uniform cross-section. A separate annular rim portion of a predetermined weight and configuration is also provided, and locking means are provided on the body and rim portions for securely interengaging said portions.

In still another alternative, the invention provides an aerodynamically-shaped flying disc comprising a circular body portion defining a web of a generally uniform cross-section and balanced weight about the center of the circular body portion. A separate, annular rim portion is also provided having a predetermined cross-sectional profile and weight, with the profile being chosen such that the rim and body portions cooperate to provide an air foil-shaped profile. Finally, means are provided for interengaging the body and rim portions.

The present invention thus provides a flying disc whose physical characteristics can be readily and easily changed. In the preferred embodiment, the disc comprises at least two distinct portions or pieces, a disc body portion and an auxiliary rim portion which is engageable with the disc body portion around the outer periphery of the body portion. The result is a disc which can be changed to suit wind conditions and to accomplish the specific objectives sought by the user, whether this be long distance flights, curved trajectories, flights of extended duration, or use of the disc in various game activities. The invention, providing as it does in the preferred embodiment an adjustable disc having interchangeable rims, allows the disc to be equipped with rims of different shapes, cross-sections and weights.

In one specific embodiment, the disc is provided with means whereby the rim portion is snap-fitted to the body portion.

In still another embodiment, a flat disc-shaped central area is semi-permanently secured to an annular rim, having a downwardly-depending skirt and central opening, by means of a semi-permanent connection, such as by bonding, welding and heat-staking.

In the case of the snap-fitted, or friction-fitted, detachable rim portions, the user is normally provided with a selection of different rims, varying from narrow, thin, flat, band-like configurations to heavier, more rounded configurations that are generally pear-shaped or teardrop-shaped in cross-section. The heavier, thicker rims, in some embodiments, are molded or machined to provide downwardly-opening, slots extending at predetermined locations and the disc is provided with downwardly-depending complementary shaped tabs or pins which engage the slots.

In still another embodiment of the disc of the present invention, the disc has a central portion and an integrally formed downwardly-depending rim portion. In one particular variation the central portion and rim portion all are uniform in cross-section. By attachment of auxiliary rim portion, the profile and weight is adjusted to specific requirements. Attachment is accomplished in one of several ways, including the provision of a series of a spaced-apart attachment points welded or machined into the rim portion of the disc. The spaced-apart attachment points provide the means whereby the auxiliary rim portion can be attached to the rim or periphery of the disc. By predetermined shaping, the auxiliary rim portion, when attached to the body portion, results in a disc with a differently shaped rim. Such an auxiliary rim portion increases the weighting of the disc, depending upon the amount of weight incorporated into the auxiliary rim portion, and changes the gripping surface of the rim of the disc. By shaping the auxiliary rim portion of the desired configuration, the gripping surface of the disc can be adjusted to the particular hand size of the user and to the grip that is preferable and most comfortable to the user.

In still another embodiment the disc has a central portion and an integrally-formed rim portion wherein the rim portion is molded or machined so as to provide thin upwardly and downwardly-opening slots circumscribing the disc. Auxiliary rim portions adopted to engage the slots are provided to accomplish the desired change in weight, shape and design of the disc.

DESCRIPTION OF THE DRAWINGS

These and other advantages of the present invention will be better understood by reference to the drawings wherein FIG. 1A is a cross-sectional view of a disc in which the free edge has a plurality of pop beads formed therein to which a rim portion of a specific configuration is attached;

FIGS. 1B, 1C, 1D, and 1E are sectional views of alternate embodiments of the disc of FIG. 1A;

FIG. 3A is a cross-sectional view of a flying disc with a flat central plate to which an annular, separate dome-shaped skirt portion, having a central opening, is semi-permanently attached along the periphery of the inner edge of the annulus;

FIGS. 3B, 3C, 3D, 3E, 3F and 3G are sectional views illustrating alternate methods of attachment of the skirt portion of FIG. 3A to the flat, central plate;

DETAILED DESCRIPTION OF THE INVENTION

Figure 2A:
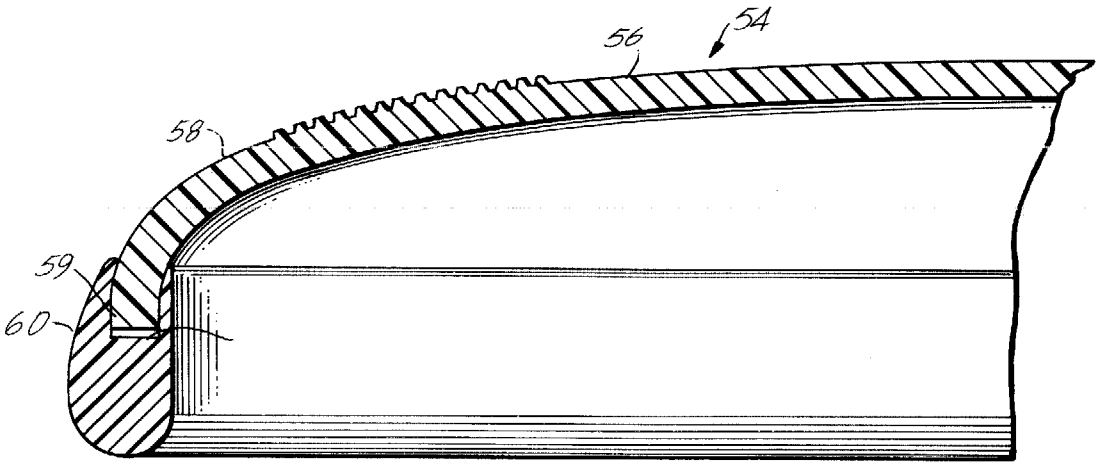
FIG. 2A is a cross-sectional view of a disc having a central, circular portion and an integral circumscribing skirt portion with a separate rim portion semi-permanently secured to the free periphery of the skirt portion.

The flight characteristics of flying discs having an inverted saucer shape have been found to depend on a number of physical characteristics. These characteristics include the overall height of the disc, the specific cross-sectional profile of the disc, its weight, the dimensions of its downwardly-depending rim portion, and the weighting and shape of the rim portion. Depending upon the particular physical characteristics chosen and imparted to the disc, flights of long distance, extended flight time and curved trajectory can be achieved. The overall diameter of the disc is also a factor. Prevailing wind conditions also influence the choice of the configuration of the disc to be used. Under heavy wind conditions, a disc with a low profile and heavier weighting is preferred for control and stability purposes.

The disc shown in FIGS. 1A–1E is illustrative of the multiple piece disc of the present invention, specifically, a two-piece disc having a body portion and an interchangeable rim portion which can be engaged and detached by the user by means of snap-fitting or friction-fitting attachment. For a more permanent connection, the rim is bonded or secured to the body portion by one of a number of different semi-permanent methods as shown in FIGS. 2 and 3. With the disc according to the present invention the user has a selection of rims of different shape and weight available to him. He selects or experiments with different rims to determine the rim most suited for his particular use of the disc and most suited to the particular wind conditions which are being encountered.

The two-piece disc illustrated in FIGS. 1A–1E utilize a plurality of "pop" beads which are formed into the downwardly-facing edge of the rim of a disc and located at spaced intervals around the rim. The "pop" beads engage mating apertures provided in a slotted auxiliary ring which is engageable with the rim to provide the adjustable flight characteristic feature of the invention. As shown in FIG. 1A, a disc 10 comprises a central body portion 12 surrounded by an integrally formed, downwardly-curved peripheral portion 14 and a rim 16 extending vertically downward. A disengageable slotted ring 18 is attached to the rim 16 by means of a "pop" bead 20. A plurality of such beads 20 are located at spaced intervals around the rim 16. The detachable rim piece 18 is an annular ring, generally oblong in cross-section, having an annular slot 22 formed therein extending around the ring 18, resulting in a pair of ring halves 26, 28 joined by a web 24. Web 24 is provided with apertures 30 for receiving "pop" beads 20. The configuration of rim portion 18 having, as it does, two rim halves, one, located on the exterior of the side of the disc and the other, on the interior of the side of the disc provides balanced weighting on both sides of the rim 16.

The discs of FIGS. 1B, 1C, 1D and 1E are similar to that of FIG. 1A and illustrate different configurations of the auxiliary rim portion which is used with this embodiment of the multi-piece disc of the present invention. In FIG. 1B, auxiliary rim portion 32 brackets both sides of the downwardly-extending rim 34, with the interior half 36 of the rim portion being heavier and larger to weight the interior side of the saucer and increase the lifting surface area presented to the air stream by the overall rim configuration. The rim portion 38 of FIG. 1C has an auxiliary web portion 40 integrally formed into the interior side of the auxiliary rim 38. Web portion 40 has a curved cross-sectional profile and is spaced from the interior surface of the disc to provide a hollow-rimmed disc. The rim portion 42 of FIG. 1D is similar to rim portion 32 of FIG. 1B, with the addition that a plurality of striations 44 are provided on the inner rim portion half 46 at the free end thereof to improve the grip of the saucer. The disc of FIG. 1E has a rim porton 48 formed in a slotted configuration to provide downwardly-facing slots 50, 52 resulting in improved lift characteristics of the disc.

Figure 2B:
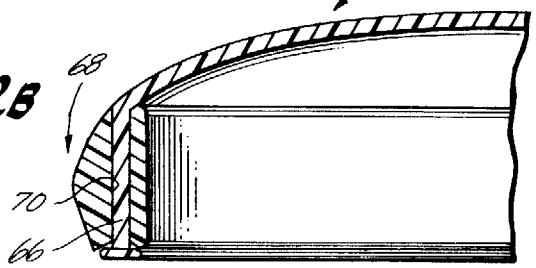
FIG. 2B is a cross-sectional view of a disc having a central portion and a plurality of depending pins integrally formed with the central portion with an auxiliary rim portion secured to the depending pins.

In FIGS. 2A and 2B are shown two-piece discs in which semi-permanent connections are made between the body portion of the disc and the rim portion. As shown in FIG. 2A, a disc 54 comprises a central body portion 56, and an integral peripheral portion 58 which terminates in a truncated, downwardly-turned lip 59. A separate rim portion 60 in the form of a circular ring having a slot 62 adapted to receive lip 59 of peripheral portion 58 is secured to the lip by one of the conventional semi-permanent attachment methods, such as bonding or ultrasonic welding. In FIG. 2B, the disc comprises a domed central body portion 64 having a plurality of pins 66 integrally formed therewith extending downwardly from the concave side of body portion 64. An auxiliary rim portion 68 in the form of a ring is provided with slots or passages 70 located so as to register with pins 66. Rim portion 68 is fitted to body portion 64 and the pins are secured thereto by heat staking (as shown) sonic welding, bonding or other semi-permanent attachment methods. The provision of a separate rim permits the use of different colors between the body and rim portions, adjustable disc weighting and different rim shapes for different flight characteristics and grips.

The disc of FIGS. 3A–3G illustrate several variations in another embodiment of a two-piece disc with a semi-permanent connection between a body portion and a rim portion. As shown in FIG. 3A, the disc 72 comprises a body portion 74 which is a flat, circular disc. The separate rim portion 76 is a circular ring having a central opening 78, smaller in diameter than the outside diameter of disc 72. Rim portion 76 is joined around its inner periphery to the outer periphery of body portion 74 at the annulus of overlapping contact 80.

Specific methods of interconnection at a point of overlapping contact between disc and rim portion are shown in FIGS. 3B–3F. As seen in FIG. 3B, the inner peripheral edge of rim portion 82 has a necked-down, circular extension 84 raised from the inner edge of ring portion 82. Extension 84 is received and seats in a slot 86 in the outer edge of disc 88. Once in place, the rim and disc portions are secured by bonding or welding. FIG. 3C illustrates the manner in which disc 90 and rim portion 92 are joined together in an overlapping configuration by the "emabond" process. As shown, a strip of bonding material 94 is sandwiched between the overlapping junction of the disc 90 and the rim 92.

In FIG. 3D, an auxiliary rim portion 96 having an upwardly opening slot 98 is secured to a flat disc portion 100. Slot 98 is adapted to receive an insert 102 which can be either snap-fitted or bonded in place resulting in a three-piece disc. Interchangeable inserts 102 permit changing color, weight, grip and flight characteristics of the disc. In FIG. 3E, two separate discs 104, 106 are joined around their peripheries to a rim portion 108 similar to that shown in FIG. 3B. Pins 110, 112 extending upwardly and downwardly from a necked-down portion 114 on rim 108 engage apertures 116 located at spaced intervals around the periphery of discs 104, 106. The assembly is secured by heat staking the pins. The advantage of the embodiment of FIG. 3E is the provision of a cavity 118 between discs 104, 106 in which specially prepared graphics can be placed during assembly. When discs 104, 106 are clear in color, the graphics can be observed from both sides. In FIG. 3F, a hot-stake method of attachment is shown. As indicated therein, a post or stake 120 extends from the undersurface of disc 122 through an aperture 124 provided in the overlapping portion of rim 126. Once the two pieces are positioned relative to each other, heat and pressure are applied to the tip of post 120, causing it to overlap the aperture and lock the disc to the rim. In FIG. 3G, the configuration is reversed. Stakes 128 are provided on rim portion 130 and are located to engage apertures 132 on flat central disc 134. Securing is again by heat staking.

Figure 4:
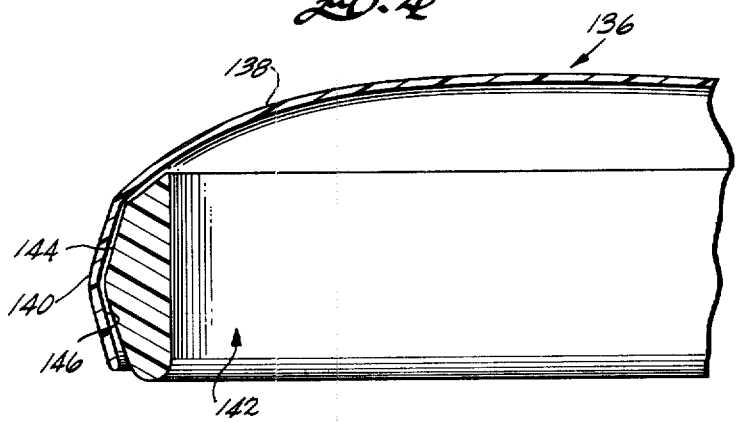
FIG. 4 is a cross-sectional view of a thin disc shell having a downwardly-depending rim portion to which an auxiliary rim portion is fitted on the interior side thereof.

The disc of FIG. 4 is illustrative of a disc configuration in which the construction and configuration of the disc provides the means for retaining auxiliary rim portions in place. As shown in FIG. 4, a disc 136 has a domed circular body portion 138 bounded by an integrally-formed, downwardly-depending curved rim portion 140. Rim portion 140 and body portion 138 are of a uniform thin cross-section and the curvature of rim portion 140 is selected such that it is undercut and retains a ring of material of a complementary shape and size.

To modify the weight of the disc and the shape of the rim 140, a band or ring 142 is fitted to the interior of the disc adjacent rim 140. Ring 142 is specially formed such that it has a belly portion 144 which conforms to and seats in undercut 146. Being formed of a deformable material having a spring constant, ring 142 also has a tendency to form itself to the inner surface of the rim. Auxiliary rim or ring 142 performs a number of functions in addition to weighting and shaping the rim, including strengthening the rim of the disc and, by suitable choice of color of the disc and auxiliary rim portion providing a contrasting band or stripe around the rim of the disc.

Figure 5A:
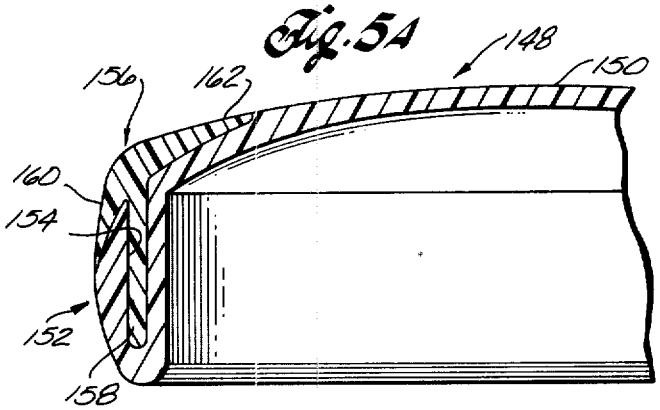
FIG. 5A is a cross-sectional view of a disc having an integral slotted rim portion and a ring of a predetermined configuration interlocking with the slotted rim.
Figure 5B:
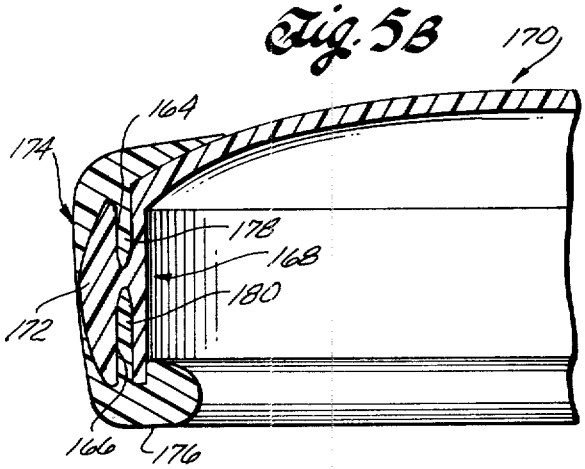
FIGS. 5B and 5C are alternate embodiments of the slotted rim and interlocking rim of FIG. 5A.
Figure 5C:
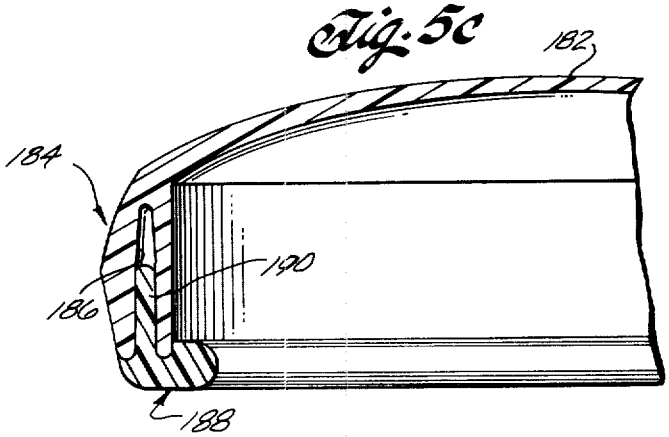

The embodiment of FIGS. 5A, 5B, and 5C provides a disc having a circular central portion and a downwardly-depending slotted rim portion integrally formed therewith, capable of being thrown or launched and flown in the conventional manner. As shown in FIG. 5A, the disc 148 comprises a central body portion 150 which has approximately the same body curvature as the discs of the prior art. The central body portion is bellied outwardly and upwardly slightly and then merges around its periphery into an essentially perpendicular rim portion 152 having an upwardly-opening slot 54. A generally T-shaped auxiliary rim portion 156 having a downwardly-depending leg 158 is attached to the disc by engaging leg 158 in slot 154. The outer surface of the disc and the arms 160, 162 of rim portion 156 is "fitted" to the rim of the disc providing a smooth unbroken surface line from the top of the disc along the rim to the end of the skirt or rim portion 152. The disc of FIG. 5A is particularly suited for applications where a change in the flight characteristics of the disc is accomplished by the weighting and thickening of the rim of the disc. As can be seen from FIG. 5A, leg 158 and slot 154 are adapted to engage and register with each other.

In an alternate embodiment of the disc of FIG. 5A, the disc of FIG. 5B has two exterior slots 164, 166 formed into the exterior of the rim portion 168 of disc 170, thereby resulting in an exteriorly facing boss 172 which is bracketed by slots 164, 166. An auxiliary rim portion 174 is molded with an interior surface configuration designed to mate with boss 172 and slots 164, 166. In contrast to the embodiment in FIG. 5A, the auxiliary rim portion 174 is significantly larger in cross section and provides a substantially thickened ridge or ring 176 extending around the bottom of the saucer and facing inwardly. The upper portion of auxiliary ring portion 174 is likewise shaped so as to taper toward the dome of the disc providing a smooth surface line from the top of the disc to the exterior edge thereof. Auxiliary rim portion 174 is formed of a pliable material to permit the engagement of circumferential tabs 178, 180 in slots 164, 166, respectively so that the rims of different sizes, weights and colors in the configuration shown in FIG. 5 can be interchangeably attached to the basic disc.

The embodiment of the disc of FIG. 5C illustrates a configuration which is opposite to that of the disc of FIG. 5A. As shown therein, the disc comprises a central dome portion 182 and a circumscribing rim portion 184 having a downwardly opening slot 186 formed into portion 184. An auxiliary rim portion 188 having a circular tab 190 is secured to the disc by engaging tab 190 in slot 186. In the embodiment shown in FIG. 5C, and optionally as well as in the embodments shown in FIGS. 5A and 5B, additional means of securement, such as by welding or bonding, is also required.

Figure 6:
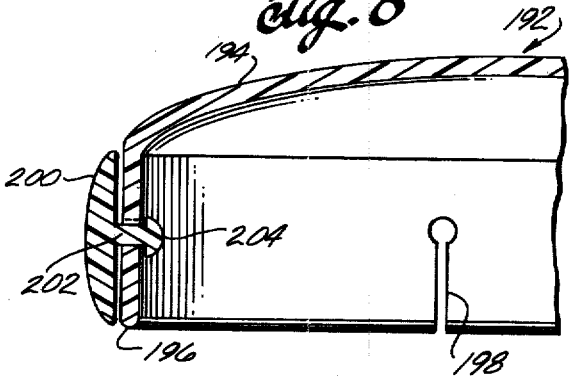
FIG. 6 is a cross-sectional view of a flying disc in which a circumscribing auxiliary rim portion is slid or snap-fitted into receiving slots in the rim portion of the disc.

In FIG. 6 a disc 192 having a central body portion 194 and a downwardly depending vertical rim portion 196 is shown. At spaced intervals around the periphery of the disc a key-hole slot 198 is formed into rim portion 196. An auxiliary rim portion 200 is secured to the disc by means of the key-hole slots. As seen in FIG. 6, auxiliary rim portion 200 has a pin or knob 202 with a flattened head 204 extending radially inwardly from rim portion 200. Pins 204 are adapted to engage in and be secured by the key-hole slots 198. Thus this embodiment of the disc is likewise provided with interchangeable rims to change the appearance, weight, feel and flight characteristics of the discs when in use.

Figure 7A:
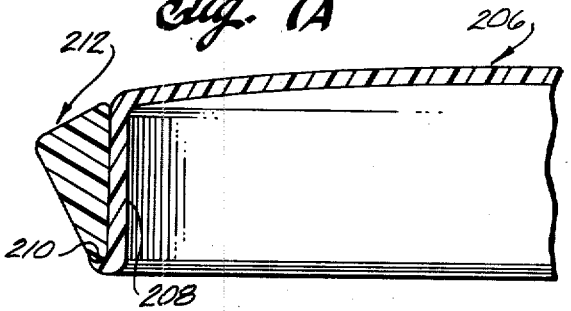
FIG. 7A is a cross-sectional view of a disc having a downwardly-depending rim portion to which an auxiliary band portion of a predetermined configuration is friction fitted.
Figure 7B:
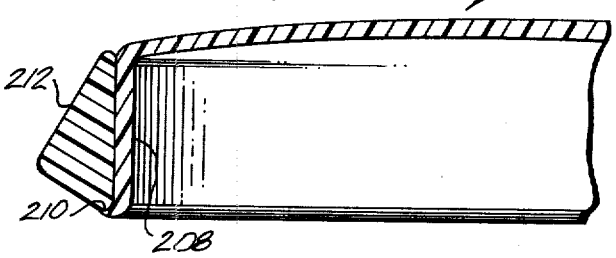
FIG. 7B is a cross-sectional view of an alternate embodiment of the disc of FIG. 7A having the circumscribing band inverted.

The discs shown in FIGS. 7A and 7B illustrate a generally flat disc 206 having a downwardly-depending rim portion 208 into which is formed a trough or shelf 210 at the base thereof on the exterior side of the disc. An auxiliary rim portion 212 formed of an elastic material having a complementary diameter to the outer diameter of the disc is positioned around the periphery of the rim to provide the two-piece configuration according to this embodiment. As can be seen from FIGS. 7A and 7B, auxiliary rim portion 212 can be inverted depending upon the rim configuration desired in flight characteristics to be obtained.

Figure 8A:
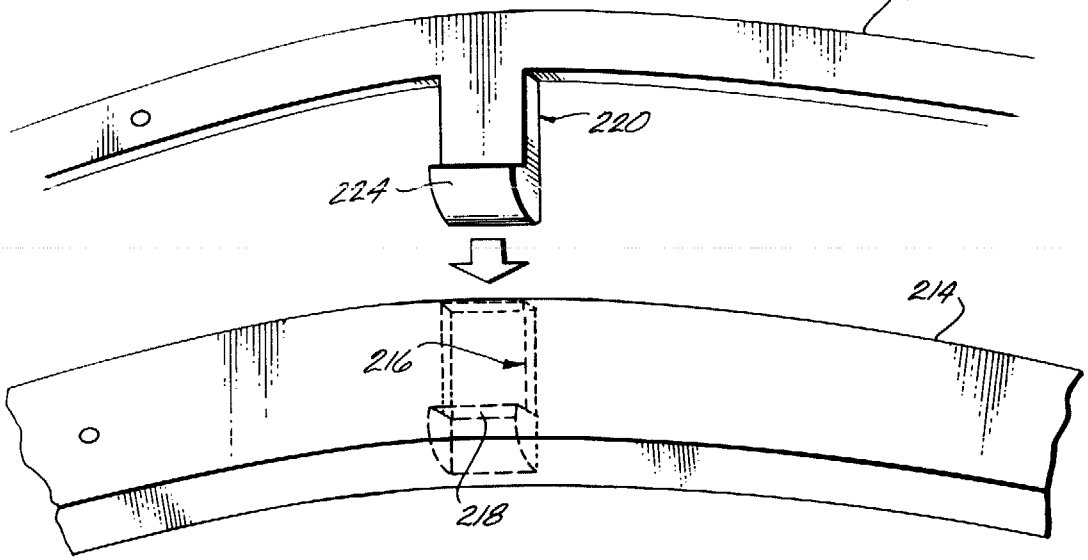
FIG. 8A is a cross-sectional view of another embodiment of disc in which a slotted rim portion is snap-fitted into downwardly-depending slot tabs spaced along the periphery of the body portion.
Figure 8B:
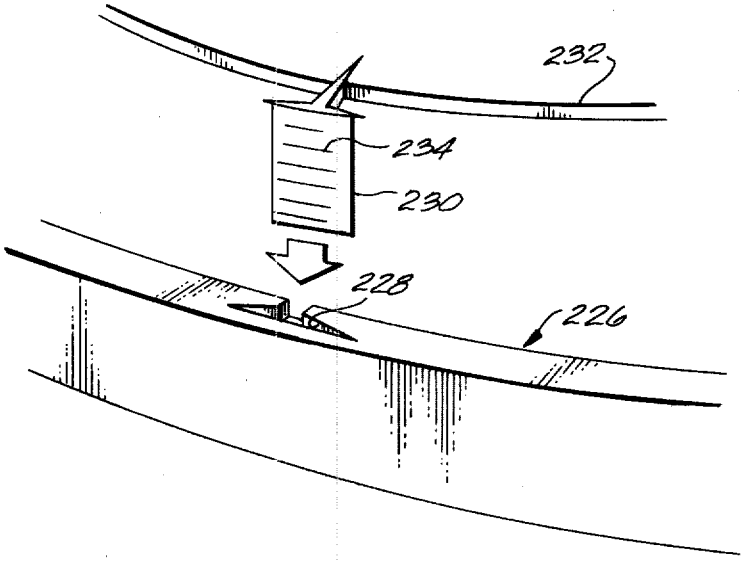
FIG. 8B is a cross-sectional view of an alternate embodiment of the disc of FIG. 8A, having tabs and slots of a different configuration.

Finally in FIGS. 8A and 8B, a method of attaching an auxiliary rim portion by means of interlocking tabs is illustrated. In FIG. 8A, an auxiliary rim portion 214 is provided with a slot 216 having an undercut portion 218. A plurality of such slots are spaced around the circumference of auxiliary rim portion 214. These slots are adapted to be received and engaged by downwardly-depending tabs 220 formed into the periphery of a central disc portion 222. The auxiliary rim portion is snapped to the central disc portion 222 by inserting tabs 220 into slots 216 and forcing the two elements together to snap a protruding shoulder 224 in tab 220 into undercut portion 218.

In FIG. 8B, an auxiliary rim portion 226 has a series of triangularly-shaped slots 228 formed transversely of the rim portion which are adapted to receive triangularly-shaped tabs 230 formed into a circular central portion 232 of the disc. The surface of tabs 230 has surface striations as a saw-tooth pattern or ridges 234 formed therein to provide a good frictional contact with the interior surfaces of slot 228 to provide a satisfactory and secure attachment of auxiliary rim portion to central circular portion.

What is claimed is:

1. An aerodynamically-shaped circular flying disc comprising a domed body having a circular central portion of a generally uniform cross-section and a downwardly depending skirt portion; and a separately integral circular rim portion having an upwardly opening passage extending annularly around the rim portion and a generally greater cross-sectional area than said central portion, said rim portion being secured to the skirt portion at the annular passage such that the rim portion brackets the skirt portion, the cross-sectional profile of the central portion and rim portion conforming to that of an airfoil.

2. The disc according to claim 1 further comprising means for snap-fitting the rim portion to the central portion.

3. The disc according to claim 1 wherein the rim portion has a first annular outer portion extending around the exterior of the domed body and a second annular inner portion integrally formed with the outer portion extending around the interior of the domed body, the inner portion being heavier and larger in cross-sectional profile than the outer portion for weighting the interior side of the disc and for increasing its lifting surface area.

4. The disc according to claim 3 wherein the inner rim portion includes an auxiliary web portion integrally formed into the inner rim portion, the web portion having a curved cross-sectional profile extending toward the center of the disc for providing a hollow-rimmed disc.

5. The disc according to claim 3 wherein the inner rim portion defines a plurality of surface striations along the lower edge of the inner rim portion for improving the grip of the disc.

6. An aerodynamically-shaped flying disc comprising a circular central body portion having a generally uniform cross section;

an annular rim portion integrally formed with the body portion depending from the plane of the body portion to provide the disc with a skirt portion of predetermined length; and a deformable circular auxiliary portion having a cylindrical passage extending annularly around the auxiliary portion, said auxiliary portion being detachably engageable along the cylindrical passage with the interior and exterior side of said annular rim portion for providing disc profile and weighting adjustments whereby different disc flight characteristics are obtained.

7. The disc according to claim 6 wherein the skirt portion is undercut and the auxiliary portion is attached to the interior of the disc.

8. The disc according to claim 6 wherein the annular rim portion includes an outwardly-extending circumferential shelf at the terminal edge of the skirt for detachably engaging the auxiliary portion.

9. An aerodynamically-shaped flying disc comprising a domed body having a central, generally flat, circular portion bounded by a bent outer portion providing the body portion with an upwardly-directed convex configuration and a downwardly-directed concave configuration, the central circular portion having a generally uniform cross-section;

a separately integral annular rim portion of a predetermined weight and configuration having an axially oriented slot extending annularly around the rim portion whereby the rim portion brackets the bent outer portion when the slot and bent portion are engaged; and joining means provided in the body and rim portions for securely interengaging said portions.

10. The disc according to claim 2 wherein the joining means provided in the body and rim portions are snap-fittings.

11. Apparatus for providing an aerodynamically adjustable flying disc comprising a body portion and a separate rim portion;

the body portion being balanced about a center of rotation of the disc and having joining means located on a downwardly depending outer perimeter of the body portion for detachable engagement with the rim portion; and the rim portion having a predetermined weight and cross-sectional profile and an upwardly opening annular slot for receiving and continuously bracketing the entire outer perimeter of the body portion and engaging means for cooperatively interlocking with the joining means of the body portion to provide a disc having adjustable flight characteristics.

12. The disc according to claim 11 wherein the rim portion defines an upwardly-opening slot and the downwardly depending outer perimeter of the body portion is engaged in said slot.

* * * * *